US012800184B2

(12) United States Patent
Baldwin, Jr.

(10) Patent No.: US 12,800,184 B2
(45) Date of Patent: Nov. 17, 2026

(54) CONDENSATE TRAY ASSEMBLY AND METHODS OF FILTERING CONDENSATE

(71) Applicant: Midea Group Co., Ltd., Foshan (CN)

(72) Inventor: Donald William Baldwin, Jr., Louisville, KY (US)

(73) Assignee: Midea Group Co., Ltd., Foshan (CN)

( * ) Notice: Subject to any disclaimer, the term of this patent is extended or adjusted under 35 U.S.C. 154(b) by 234 days.

(21) Appl. No.: 18/593,209

(22) Filed: Mar. 1, 2024

(65) Prior Publication Data

US 2025/0277601 A1 Sep. 4, 2025

(51) Int. Cl.
*F24F 13/22* (2006.01)

(52) U.S. Cl.
CPC ..... *F24F 13/222* (2013.01)

(58) Field of Classification Search
CPC ..... F24F 13/22
See application file for complete search history.

(56) References Cited

U.S. PATENT DOCUMENTS

| | | | | |
|---|---|---|---|---|
| 2,081,553 | A * | 5/1937 | Neeson | F24F 13/22 55/497 |
| 10,422,567 | B2 | 9/2019 | Grantham | |
| 2009/0071181 | A1 | 3/2009 | Spanger | |
| 2014/0109602 | A1* | 4/2014 | Cerdan | F25D 17/042 62/85 |
| 2018/0347850 | A1* | 12/2018 | Hancock | F24F 1/0067 |
| 2020/0324239 | A1* | 10/2020 | Lin | B01D 46/12 |

FOREIGN PATENT DOCUMENTS

| | | | |
|---|---|---|---|
| CN | 209978334 | U | 1/2020 |
| CN | 107477835 | B | 9/2020 |
| CN | 211585701 | U | 9/2020 |
| CN | 215724070 | U | 1/2022 |
| CN | 114383314 | A | 4/2022 |
| CN | 114383315 | A | 4/2022 |
| CN | 219913302 | U | 10/2023 |

* cited by examiner

*Primary Examiner* — Elizabeth J Martin
(74) *Attorney, Agent, or Firm* — Dinsmore & Shohl LLP

(57) ABSTRACT

Apparatuses and methods of a condensate tray assembly for filtering condensate from a heat pump include a base plate, side walls, and a plurality of contaminant traps. The base plate includes a proximal end, a distal end, a left side edge, and a right side edge. The proximal end is configured to be elevated relative to the distal end such that the condensate from the heat pump flows from the proximal end of the base plate toward the distal end of the base plate. The side walls are removably coupled to the base plate near the side edges. The plurality of contaminant traps are removably coupled to the base plate. Each contaminant trap includes an inflow leg and an outflow leg. The contaminant traps are aligned against the condensate flow to facilitate collection of contaminants present in the condensate as the flow of condensate traverses across the condensate tray.

18 Claims, 5 Drawing Sheets

CONDENSATE TRAY ASSEMBLY AND METHODS OF FILTERING CONDENSATE

TECHNICAL FIELD

The present disclosure generally relates to heat pump systems, and more particularly, to condensate tray assemblies for heat pump systems that remove contaminants from condensate.

BACKGROUND

Heat pump systems are widely appreciated for their efficient cooling and heating capabilities. However, dealing with condensate during operation can be challenging, especially in environments where dripping condensate might pose risks or cause damage to people and property. Traditional methods of managing condensate often involve transporting the condensate to various downstream processes, but these approaches can lead to system blockages and/or clogging due to contamination in the condensate. Additionally, substituting contaminant removal mechanisms in these methods often requires an undesirable disassembly process. Therefore, there is a need for a removable condensate trap apparatus that facilitates the transfer of condensate to downstream processes while passively collecting contaminants in the condensate with minimal or no risk of overflow or blockages.

SUMMARY

In some embodiments, a condensate tray assembly for filtering condensate from a heat pump includes a base plate, side walls, and a plurality of contaminant traps. The base plate includes a proximal end, a distal end, a left side edge, and a right side edge. The proximal end is configured to be elevated relative to the distal end such that the condensate from the heat pump flows from the proximal end of the base plate toward the distal end of the base plate. The side walls are removably coupled to the base plate near the side edges. The plurality of contaminant traps are removably coupled to the base plate. Each contaminant trap includes an inflow leg and an outflow leg. The contaminant traps are aligned against the condensate flow to facilitate collection of contaminants present in the condensate as the flow of condensate traverses across the condensate tray.

In some embodiments, a method of filtering contaminants from condensate generated by a heat pump system is provided, the method including providing a condensate tray assembly with contaminant traps for a heat pump system, inserting the condensate tray assembly into a condensate tray slot of the heat pump system, activating the heat pump system to generate condensate, allowing the condensate tray assembly to collect the condensate, allowing condensate to traverse the condensate tray assembly from an inlet side to an exit side, allowing contaminant traps to capture contaminants from the condensate, and allowing filtered condensate to flow to distribution system.

In other embodiments, a condensate tray assembly for filtering condensate from a heat pump includes a base plate, one or more guide walls, and a plurality of contaminant traps. The base plate includes a proximal end, a distal end, a left side edge, and a right side edge. The promixal end is configured to be elevated relative to the distal end such that the condensate from the heat pump flows from the proximal end of the base plate toward the distal end of the base plate. The one or more guide walls are mechanically coupled to the side edges of the base plate to direct the condensate to flow into the condensate tray assembly. The guide walls are operably coupled to one or more incline panels or extend upward to include the one or more incline panels. The plurality of contaminant traps are removably coupled to the base plate. Each contaminant trap includes an inflow leg and an outflow leg. The contaminant traps are aligned against the condensate flow to facilitate collection of contaminants present in the condensate as the flow of condensate traverses across the condensate tray.

These and additional features provided by the embodiments of the present disclosure will be more fully understood in view of the following detailed description, in conjunction with the drawings.

BRIEF DESCRIPTION OF THE DRAWINGS

The embodiments set forth in the drawings are illustrative and exemplary in nature and not intended to limit the disclosure. The following detailed description of the illustrative embodiments can be understood when read in conjunction with the following drawings, wherein like structure is indicated with like reference numerals and in which.

DETAILED DESCRIPTION

Figure 1:
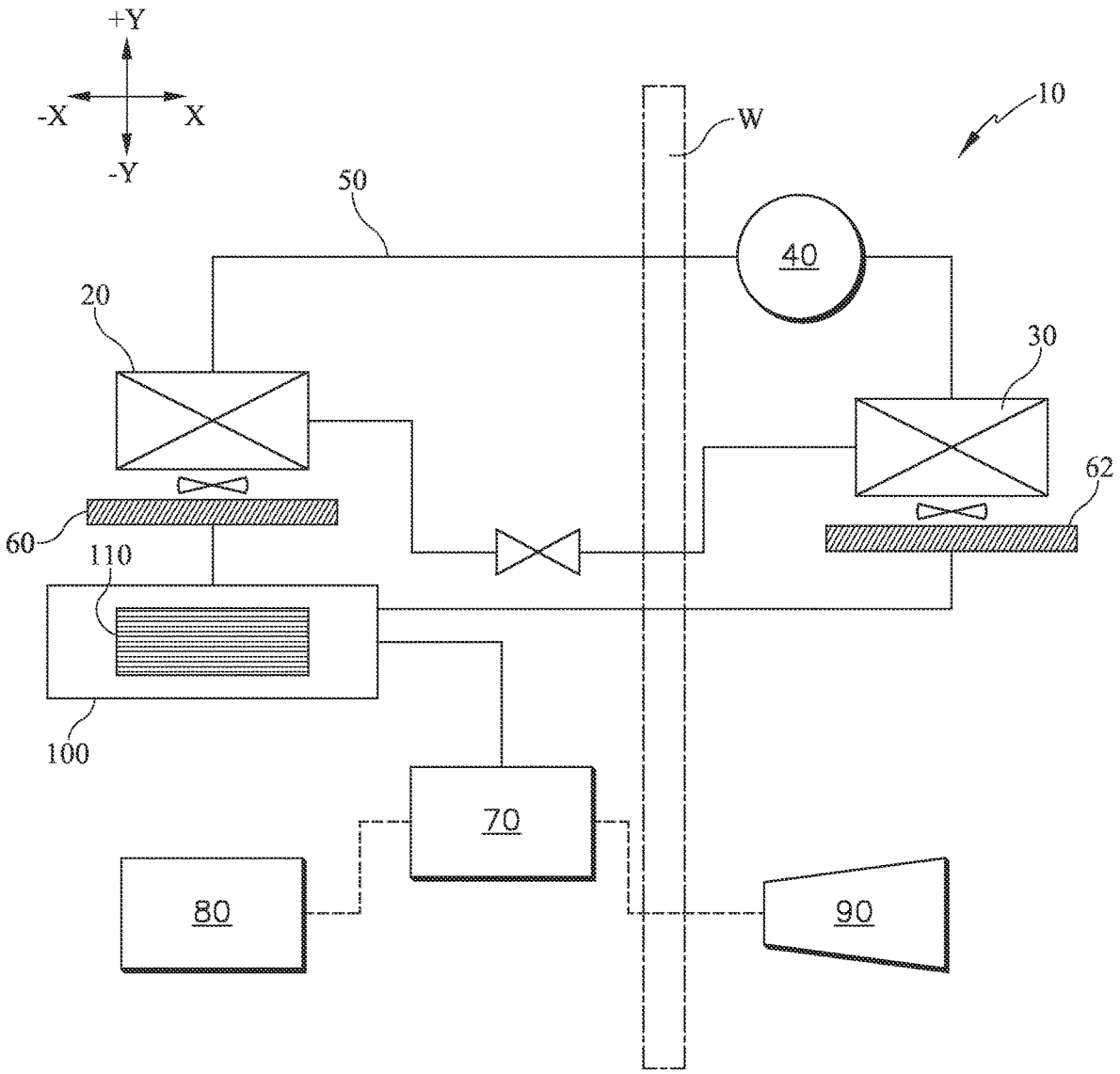
FIG. 1 is a schematic view of a heat pump system in accordance with one or more embodiments shown and described herein.

The embodiments described herein are directed to a removable condensate tray assembly, heat pump system, and methods of filtering condensate. More specifically, the present disclosure relates to a removable condensate tray assembly for heat pump systems that are configured to passively remove contaminants from condensate formed and collected during heating and/or cooling processes. Condensate trays or relevant filtering mechanisms in heat pump systems often rely on fixed condensate trays, which lack the convenience of easy removal, making maintenance tasks like changing or cleaning contaminants a cumbersome process. This limitation can result in reduced system efficiency over time as debris accumulates, potentially leading to clogs or blockages that can negatively impact the heat pump's performance. Additionally, the lack of accessibility in traditional systems may increase the overall maintenance time and effort required, making it less practical for routine upkeep.

The present disclosed condensate tray assembly and relevant structures provide passive condensate trays including mechanisms for slideable installation and/or removal, offering desirable advantages in terms of maintenance and efficiency. For example, the removable condensate tray assembly may be configured to be slidably engaged with a condensate tray slot of the heat pump system. The condensate tray assembly may be configured to be operably engaged with the condensate tray slot to filter the condensate, and to be operably disengaged from the condensate tray slot to remove captured or collected contaminants. The ability to disengage the condensate tray assembly from the heat pump system, for example by slidably removing it, simplifies the process of accessing and cleaning contaminant traps, allowing for quicker and more convenient maintenance. The present disclosed apparatus, systems, and methods not only promote regular upkeep but also minimize downtime of the heat pump systems during maintenance activities.

In the present disclosure, the condensate tray assembly may include a base plate, which includes a distal end, a proximal end. The proximal end may be further elevated relative to the distal end, such that the base plate is sloped. As condensate traverses the plurality of contaminant traps, contaminants may be removed from the condensate. Furthermore, the slope of the base plate of the condensate tray assembly allows the condensate to traverse the condensate tray assembly passively (e.g., via the force of gravity). By passively filtering the condensate, contaminants may be removed from the condensate via the condensate tray assembly before the condensate is transferred to other downstream components of the heat pump system. The condensate tray assembly may be disengaged from the condensate tray slot of the heat pump system to facilitate cleaning of the contaminant traps when the contamination degree of the contaminant traps reaches a certain level of contamination.

As described herein, condensate forms on heat exchangers (e.g., evaporation/condenser coils) of heat pump systems during operation. For example, during a heating cycle, the outdoor heat exchanger acts as an evaporation coil. Accordingly, when humidity levels are sufficiently high, condensation may form and cascade down the outdoor heat exchanger. Conversely, during a cooling cycle, the indoor heat exchanger may act as an evaporation coil, such that condensate may form and cascade down the indoor heat exchanger. A filtration system that utilizes the force of gravity to filter contaminants from a condensate is referred to as a "passive" filtration system.

In certain heat pump system applications, allowing the condensate to drip out of the system is undesirable for a number of reasons. For example, condensate can present a variety of hazards for high-rise multi-family apartments and/or condos in areas with the potential for freezing temperatures. In these temperatures, condensate formed by a heat pump system may freeze to form dangerous icicles that may cause injury to persons and/or property below. To address this issue, condensate needs to be handled in a more effective manner. In the heating cycle, some of the condensate can be used to humidify the indoor space, which may leave the remainder of the condensate to be returned to the outdoor environment. However, transporting the condensate to various downstream processes creates the opportunity for blockages that stem from the contamination of the condensate formed in these systems. Accordingly, a cleanable passive filtering system is desirable to remove the contaminants from the condensate in order to alleviate and/or eliminate issues with clogging that often occur in these downstream components (e.g., humidification systems, misting nozzles, etc.).

Embodiments of removable condensate tray assembly, heat pump systems, and methods of filtering condensate will now be described in additional detail herein.

Referring now to FIG. 1, a schematic view of a heat pump system 10, such as a window heat pump system, is depicted. The heat pump system 10 may include a first heat exchanger 20, a second heat exchanger 30, a compressor 40, and a plurality of refrigerant lines 50 that facilitate the heat transfer process. Although the heat pump system 10 of FIG. 1 is depicted as being a window heat pump system, it should be appreciated that the heat pump system 10 may be any type of heat pump or air conditioning unit capable of providing cooling and heating to indoor spaces without departing from the scope of the present disclosure.

As further depicted in FIG. 1, the heat pump system 10 may be a compact and/or self-contained device that is configured to be installed within a window W or other similar wall opening, thereby allowing for integration of the heat pump system 10 into various environments. Accordingly, it should be appreciated that once the heat pump system 10 is installed, various components of the heat pump system 10 may be positioned on either an "indoor" side of the heat pump system 10 or an "outdoor" side of the heat pump system 10, as will be described in additional detail herein.

For example, in the embodiments described herein, the first heat exchanger 20 and the second heat exchanger 30 may be positioned on opposite sides of the heat pump system 10. As depicted in FIG. 1, the first heat exchanger 20 may be positioned on the indoor side of the heat pump system 10 (e.g., in the −x-direction relative the window W as depicted in the coordinate axis of FIG. 1), while the second heat exchanger 30 may be positioned on the outdoor side of the heat pump system 10 (e.g., in the +x-direction relative the window W as depicted in the coordinate axis of FIG. 1).

Referring still to FIG. 1, in these embodiments, in a cooling cycle, the first heat exchanger 20 may be an evaporator coil, while the second heat changer 30 may be a condenser coil. In these embodiments, the evaporator coil may absorb heat from the indoor air during a cooling cycle of the heat pump system 10 and release heat during a heating cycle of the heat pump system 10. For example, the evaporator coil may include a plurality of refrigerant-filled tubes and/or fins to aid in maximizing heat transfer during the cooling and heat cycles of the heat pump system 10, respectively.

As indoor air passes over the evaporator coil, the refrigerant within the evaporator coil absorbs heat from the indoor air, causing the indoor air to cool down. The absorbed heat from the indoor air is then passed via the refrigerant through the plurality of refrigerant lines 50 to other components of the heat pump system 10. For example, the plurality of refrigerant lines 50 may pass the refrigerant and absorbed heat from the indoor air to the compressor 40, which may compress the refrigerant such that the temperature and pressure of the refrigerant increase. The pressurized refrigerant may then pass to the condenser coil (e.g., the second heat exchanger 30 located on the outdoor side of the heat pump system 10).

In the condenser coil, the pressurized refrigerant releases the absorbed heat from the indoor air into an external environment. The external environment (e.g., outdoor air, etc.) may be at a lower temperature than the refrigerant, which may cause the refrigerant to condense back into a liquid state. This process may be continued throughout the heat pump system 10 until the indoor air has reached a desired temperature.

In contrast, during the heating cycle, the heat pump system 10 may reverse its operation. That is, during the heating cycle, the first heat exchanger 20 may act as the condenser coil, while the second heat exchanger 30 may act as the evaporator coil. In these embodiments, the compressor 40 acts to increase the pressure and temperature of the refrigerant, thereby allowing the refrigerant to release heat into the indoor space.

Referring still to FIG. 1, in some embodiments, the heat pump system 10 may further include one or more condensation pans 60 and 62, which may be positioned to collect condensate formed on the first heat exchanger 20 and/or the second heat exchanger 30. For example, as depicted in FIG. 1, the heat pump system 10 may include a first condensation pan 60 located beneath the first heat exchanger 20 (e.g., the indoor heat exchanger) and a second condensation pan 62 located beneath the second heat exchanger 30 (e.g., the outdoor heat exchanger). In these embodiments, when air reaches its dew point temperature, the water vapor in the air may condense into a liquid on the evaporator coil (either heat exchanger 20 or 30, depending on whether the heat pump system 100 is in the cooling or heating mode, respectively).

The condensate formed on the first heat exchanger 20 may accumulate within the first condensation pan 60, while condensate formed on the second heat exchanger 30 may accumulate within the second condensation pan 62. In these embodiments, the first and second condensation pans 60, 62 may include a plurality of drainage mechanisms that may aid in containing and managing the condensate collected in the first and second condensation pans 60, 62. In some embodiments, the first and second condensation pans 60, 62 may further include a pump that is configured to pump water towards the drainage mechanisms of the first and second condensation pans 60, 62, respectively, such that condensate may be dispensed from the first and second condensation pans 60, 62. In some embodiments, the condensation pan 60 may include a sloped and/or angled surface that may aid in facilitating condensate towards the drainage mechanisms, as will be described in additional detail herein with reference to FIGS. 2A-4B.

In embodiments, condensate that forms on the first heat exchanger 20 (e.g., the indoor heat exchanger) and/or the second heat exchanger 30 may contain various contaminants such as dust, dirt, debris, and other similar microbial particles. When these contaminants in the condensate are transported to a distribution system 70, the contaminants may cause clogging and other similar issues within the distribution system 70, the humidification system 80, and/or misting nozzle 90. In these embodiments, the blocking and/or clogging of the distribution system 70, humidification system 80, and/or misting nozzle 90 may result in failure of the heat pump system 10, which may in turn necessitate costly and timely repairs. In some embodiments, the distribution system 70 may include filters to remove contaminants. However, the filters may get clogged and cause overflow when the collected or retained contaminants block the filter. Therefore, the removable condensate tray assembly described herein can passively remove the contaminant in the condensate and reduce the contaminant transported to the downstream device and components. Further, as described below, due to the passive nature of the contaminant removal mechanism in the condensate tray assembly, the risks of clogging and/or blocking can minimized.

Figure 3A:
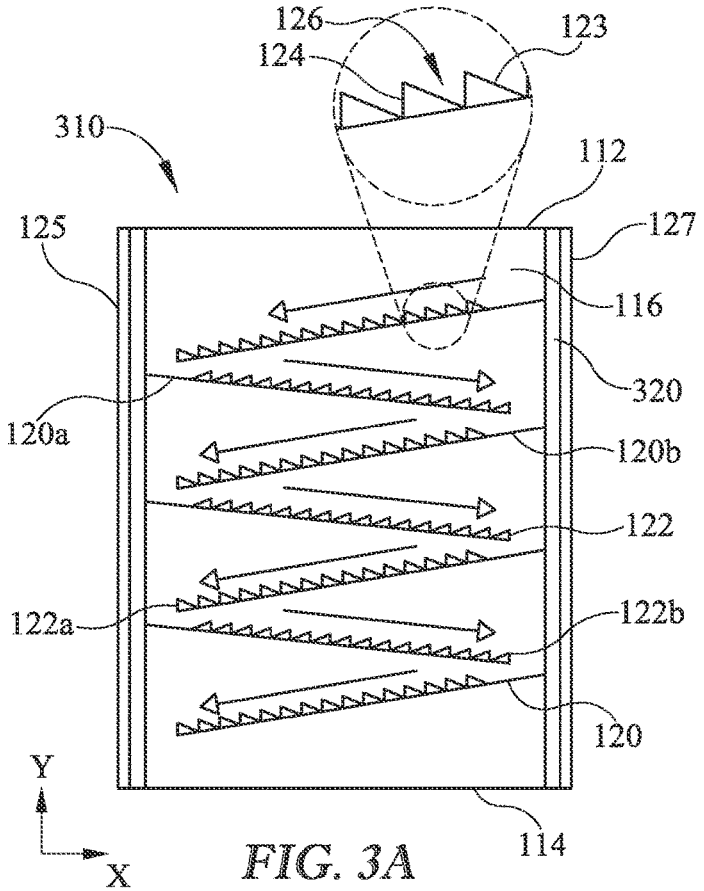
FIG. 3A schematically depicts a top view of an example condensate tray assembly having a plurality of walls according to one or more embodiments shown and described herein.
Figure 4A:
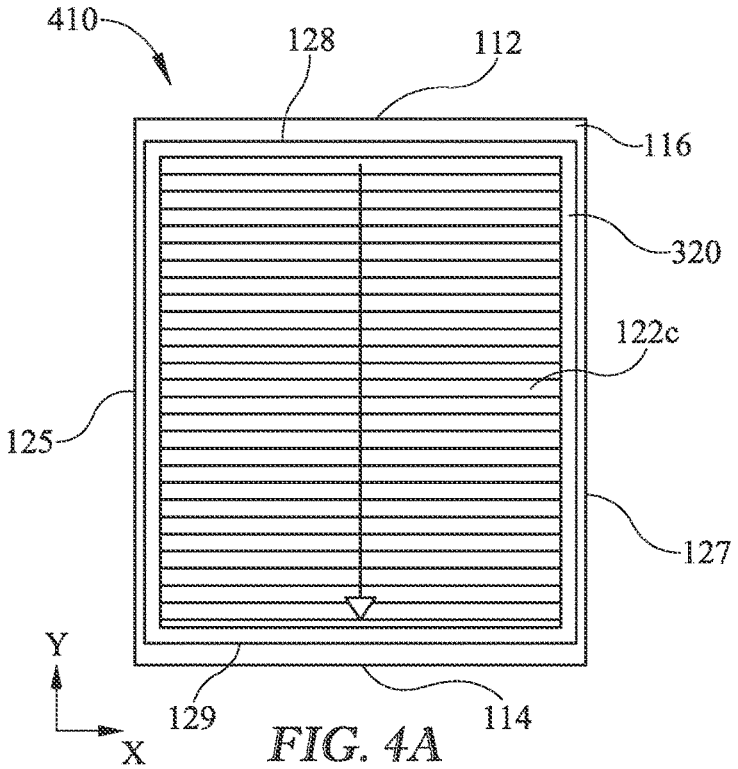
FIG. 4A schematically depicts a top view of an example condensate tray assembly having contaminant traps perpendicular to the side walls according to one or more embodiments shown and described herein.

The heat pump system 10 includes a filtration system 100. The filtration system 100 includes a condensate tray assembly 110 disposed between the first and/or second condensation pans 60, 62, and the distribution system 70 in order to remove contaminants from the condensate before the condensate is received by the distribution system 70. The distribution system 70 may include a sump basin and a sump pump to remove water that has accumulated in the sump basin. The filtration system 100 may further include a condensate tray assembly 110, which may be configured to separate contaminants from the condensate as the condensate flows across the condensate tray assembly 110. In FIGS. 3A and 4A, the condensate flows in the direction shown in the arrows. In these embodiments, the filtration system 100 may be disposed downstream of the first and/or second condensation pan 60, 62. More particularly, the filtration system 100 may be fluidly coupled to the first and/or second condensation pans 60, 62 via drainage mechanisms of the first and/or second condensation pans 60, 62, such that condensate collected in the first and/or second condensation pans 60, 62 drains into the filtration system 100.

In some embodiments, the first and/or second condensation pan 60, 62 may be fluidly coupled to the condensate tray assembly 110, such that condensate collected by either the first and/or second condensation pan 60, 62 may be transferred to the condensate tray assembly 110. For example, during a cooling cycle, condensate may form on the first heat exchanger 20 and be collected by the first condensation pan 60, after which the condensate may flow to the condensate tray assembly 110. In contrast, during a heating cycle, condensate may form on the second heat exchanger 30 and be collected by the second condensation pan 62, after which the condensate may flow to the condensate tray assembly 110. For example, the condensate generated by the second heat exchanger 30 may be collected by the second condensation pan 62 and flow and/or be pumped to the upper side (such as a proximal end 112 as in FIGS. 2A-4B) of the condensate tray assembly 110.

Figure 5A:
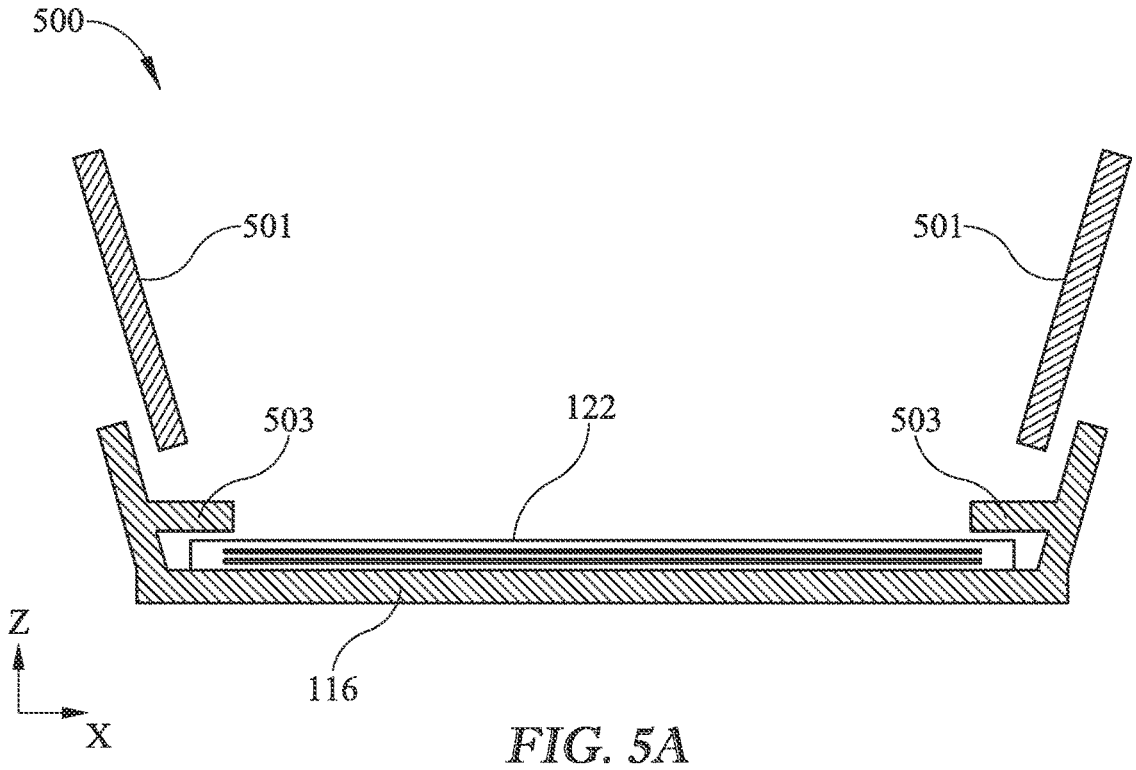
FIG. 5A schematically depicts an end view of an example condensate tray assembly including incline panels according to one or more embodiments shown and described herein.
Figure 5B:
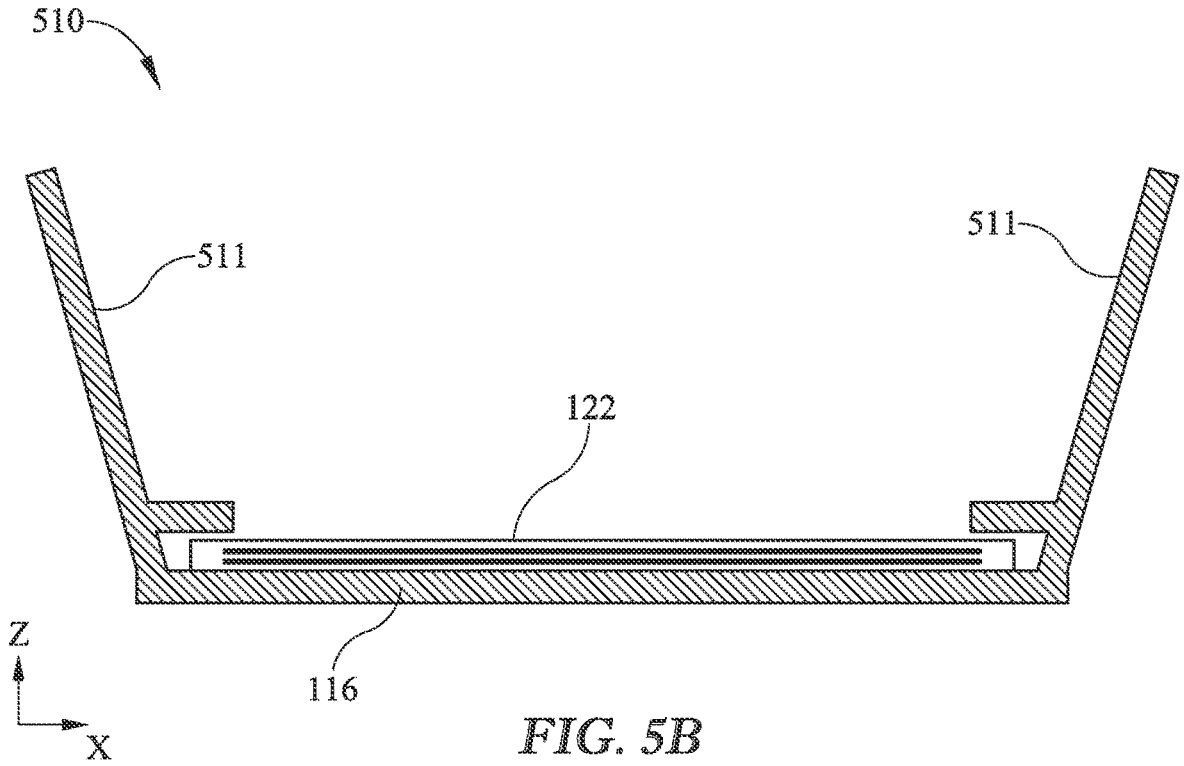
FIG. 5B schematically depicts an end view of an example condensate tray assembly including fixed incline panels according to one or more embodiments shown and described herein.

In some embodiments, the heat pump system 10 may not include the first condensation pans 60 and/or the second condensation pan 62 but may have the condensate tray assembly 110 of the filtration system 100 directly disposed under the first heat exchanger 20 and/or the second heat exchanger 30 to collect the condensate generated by the first heat exchanger 20 and/or the second heat exchanger 30. In such embodiments, the condensate tray assembly 110 may further include condensate guide mechanisms (e.g., incline panels 501 and guide walls 511 including incline panel as illustrated in FIGS. 5A and 5B) positioned above the condensate tray assembly 110 to direct the condensate to flow into the condensate tray assembly 110.

Referring again to FIG. 1, the heat pump system 10 may further include a distribution system 70 that may be configured to transport condensate collected in the first and/or second condensation pans 60, 62 to downstream components of the heat pump system 10, such as a humidification system 80 or a misting nozzle 90. For example, in some embodiments, the distribution system 70 may include a distribution pump powered by an impeller. In these embodiments, the rotation of the impeller may create a centrifugal force that draws condensate from the first and/or second condensation pans 60, 62 and into the distribution system 70. The distribution system 70 may deliver the condensate to a number of additional components of the heat pump system 10, such as a humidification system 80 or a misting nozzle 90. For example, in embodiments in which the condensate is directed towards the humidification system 80, the humidification system 80 may utilize the condensate to add moisture to the indoor air, thereby increasing humidity levels within the indoor environment. In embodiments in which the condensate is directed towards the misting nozzle 90, the misting nozzle 90 may transform the condensate into fine droplets which may be released safely into the external (e.g., outdoor) environment. In these embodiments, dispersing the condensate (either via the humidification system 80 or the misting nozzle 90) may aid in minimizing the risk of water accumulation within the heat pump system 10. Furthermore, although the schematic of FIG. 1 depicts the heat pump system 10 as having either the humidification system 80 or the misting nozzle 90, it should be appreciated that, in some embodiments, the heat pump system 10 may include both components. For example, the heat pump system 10 may further include control mechanisms that enable a portion of the condensate to be transmitted to the humidification system 80 while the remainder of the condensate is transmitted to the misting nozzle 90.

Referring again to FIGS. 2A-4B, the condensate tray assembly 110 is depicted. The condensate tray assembly 110 may include a base plate 116 and one or more contaminant traps 122. In some embodiments, the base plate 116 may be a substantially rigid material, such as, without limitations, aluminum, iron alloys, metal alloy, composites, plastics, and the like. In some embodiments, the base plate 116 may be a flexible material, such as, without limitations, certain plastics, rubber, elastic polymers, composites, and the like. The condensate tray assembly 110 can be slideably engageable with (as in FIG. 2A) and slidably disengageable from (as in FIG. 2B) the heat pump system 10. The base plate 116 may include a proximal end 112, a distal end 114, a left-side edge 125 and a right-side edge 127. The condensate tray assembly 110 may include side walls 320 removeably coupled to the base plate 116 around the side edges 125 and 127 of the base plate 116.

Figure 3B:
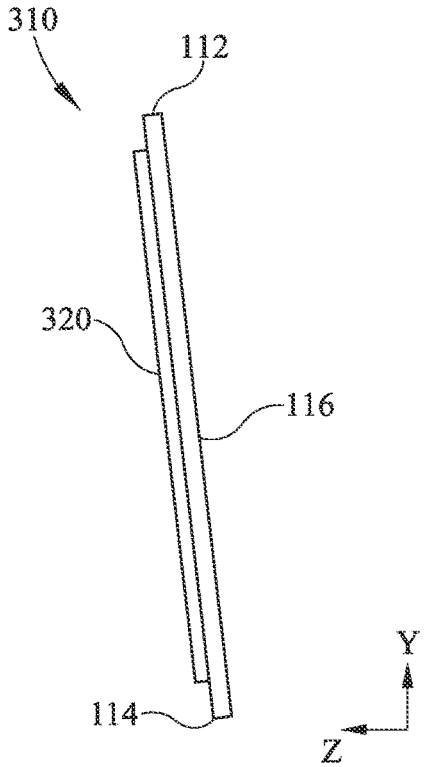
FIG. 3B schematically depicts a side view of an example condensate tray assembly having a plurality of walls according to one or more embodiments shown and described herein.

In one embodiment, the condensate tray assembly 110 includes one or more contaminant traps 122 on or coupled with the base plate 116. FIGS. 3A and 3B depict one embodiment of a top view (FIG. 3A), and a side view (FIG. 3B) of an example condensate tray assembly 310 including the contaminant traps 122. As illustrated, the condensate tray assembly 310 may further include a plurality of walls 120, which may guide the condensate across the base plate 116 of the condensate tray assembly 110 as the condensate flows from the proximal end 112 of the base plate 116 to the distal end 114 of the base plate 116. As illustrated in FIGS. 3A and 3B, a plurality of contaminant traps 122 may attach to each of the plurality of walls 120. For example, in these embodiments, as condensate flows across the plurality of contaminant traps 122 of each of the plurality of walls 120, the plurality of contaminant traps 122 may be configured to collected or retain contaminants (e.g., dust, debris, microbial particles, lint, pollen, etc.) while allowing water to pass over or through the contaminant traps 122. The condensate tray assembly 110 may be disengaged from the condensate tray slot 210 to remove the collected contaminants and/or replace the contaminant traps 122 when a contamination degree of the contaminant traps 122 reaches a predetermined level of contamination.

As illustrated in FIG. 3A, the condensate tray assembly 310 may include one or more first zigzag walls 120*a* extending from the left side edge 125 and one or more second zigzag walls 120*b* extending from the right side edge 127. The first zigzag walls 120*a* may be configured to direct the condensate to flow toward the right side edge 127, and the second zigzag walls 120*b* may be configured to direct the condensate to flow toward the left side edge 125. As such, the plurality of walls 120 creates a zig-zag filtering route for the contaminant to be filter that is longer than the distance directly from the proximal end 112 to the distal end 114 and thereby increase the efficiency of contaminant removal. It is also noted that when the contaimant traps 122 reach their maximum contaminant degree, the condensate can still flow along the zig-zag filtering route without clogging or backing up.

Figure 4B:
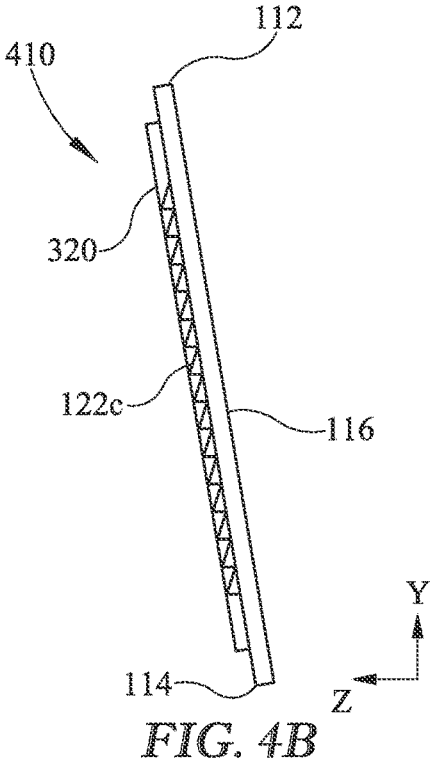
FIG. 4B schematically depicts a side view of an example condensate tray assembly having contaminant traps perpendicular to the side walls according to one or more embodiments shown and described herein.

Referring now to FIGS. 4A and 4B, a top view (FIG. 4A), and a side view (FIG. 4B) of an alternative embodiment of a condensate tray assembly 410 are depicted. The condensate tray assembly 410 may include side walls 320 extending upwards to near the side edges 125 and 127 of the base plate 116. In some embodiments, one or more of parallel contaminant traps 122*c* may be arranged to be perpendicular to the side walls 320. In some embodiments, the parallel contaminant traps 122*c* may form an angle against the side walls 320. The angle may be between 0 degree and 90 degree. For example, in these embodiments, as condensate flows across the plurality of parallel contaminant traps 122*c*, the plurality of parallel contaminant traps 122*c* may be configured to secure contaminants (e.g., dust, debris, microbial particles, lint, pollen, etc.) while allowing for water to pass through the parallel contaminant traps 122*c*. The condensate tray assembly 110 may be disengaged from the condensate tray slot 210 to replace the parallel contaminant traps 122*c* or remove the collected or retained contaminants when a contamination degree of the parallel contaminant traps 122*c* reaches a predetermined level of contamination.

As illustrated in FIG. 4A, the condensate tray assembly 410 may further include a top wall 128 and a bottom wall 129. The parallel contaminant traps 122*c* may fill the surface of the base plate 116 within the area enclosed by the top wall 128, the side walls 320, and the bottom wall 129. The condensate may be input into the area around the top wall 128, and flow from the top wall 128 to the bottom wall 129. The bottom wall 129 may include pores or slots to allow the condensate to flow out of the enclosed area to the distal end 114. The side walls 320 are taller than the parallel contaminant traps 122*c* such that when the contaimant traps 120 reach their maximum contaminant degree, the side walls 320 may secure the condensate flowing along the direction from the proximal end 112 to the distal end 114, without overflowing the left side edge 125 and/or the right side edge 127. For example, the walls 320 may be taller than the contaminant traps 122, such as the zigzag contaminant traps 122*a* and 122*b* as in FIGS. 3A and 3B and parallel contaiminat traps 122*c* as in FIGS. 4A and 4B, by any reasonable value, such as greater than approximately 0.01 cm and less than approximately 50 cm, or more.

Referring again to FIG. 3A-4B, it should be noted that the plurality of walls 120, the top wall 128, the bottom wall 129, and the side walls 320 may include any number of walls without departing from the scope of the present disclosure. In some embodiments, the condensate tray assembly 110 may include two or more side walls 320 that are taller than the contaminant traps such that the side walls 320 prevent the condensate from flowing out from the side edges 125 and 127 of the base plate 116. The taller side walls 320 can allow the contaminant traps 122 to achieve a passive settling/filtering mechanism of the present disclosure without the drawbacks of potential clogging/blocking. For example, unlike traps/filters in a sump basin or other condensate containers, where a fully contaminated filter may cause clogging or/and blocking, when the contaminant traps 122 reach or essentially reach the maximum contamination degree, the condensate may still flow in the designed flow directions without clogging or/and blocking (e.g., as in FIG. 3A, the flow direction from left to right in the channel between the zigzag walls 120*b* and 120*a*, and the flow direction from right to left in the channel between the zigzag walls 120*a* and 120*b*, as in FIG. 4*a*, from the top wall 128 to the bottom wall 129).

In some embodiments, the number of the plurality of walls 120 formed along the base plate 116 of the condensate tray assembly 310 and 410 may be determined by the amount of contaminant formed in the condensate. In some embodiments, increasing the number of the plurality of walls 120 as illustrated in FIG. 3A may increase the surface area of the zigzag contaminant traps 122*a* and 122*b* that interact with the condensate as the condensate traverses the condensate tray assembly 310, which may in turn increase the volume of contaminant that is able to be removed from the condensate. In contrast, decreasing the number of the plurality of zigzag walls 120*a* and 120*b* as illustrated in FIG. 3A may, in some embodiments, decrease the amount of contaminants able to be removed from the condensate as the condensate traverses the condensate tray assembly 310 and 410. Accordingly, the plurality of zigzag walls 120*a* and 120*b* as illustrated in FIG. 3A formed on the condensate tray assembly 110 may be determined based on the desired amount or volume of contaminant generated by a particular heat pump system 10 to be filtered.

Referring again to FIGS. 3A-4B, throughout the disclosed embodiments, each said contaminant trap 122, such as the zigzag contaminant traps 122*a* and 122*b* and parallel contaminant traps 122*c*, may include an inflow leg 123 and an outflow leg 124. A settling groove 126 may be formed between a pair of neighboring contaminant traps 122 between the outflow leg 124 of the first neighboring contaminant trap 122 and the inflow leg 123 of the second neighboring contaminant trap. The condensate flow (as illustrated in arrows in FIGS. 3A and 4A) may be directed toward the inflow leg 123 and away from the outflow leg 124. The settling groove 126 may be configured to allow suspended particles in the condensate to settle in the settling groove 126

The contaminant traps 122, such as the zigzag contaminant traps 122*a* and 122*b* and parallel contaminant traps 122*c*, may take a variety of forms without departing from the scope of the present disclosure. In some embodiments, the contaminant traps 122, such as the zigzag contaminant traps 122*a* and 122*b* and parallel contaminant traps 122*c*, may include one or more pleated screens. The pleated screens may include mesh screens or filter media. In some embodiments, the plurality of contaminant traps 122 may include micro-sized perforations or pores that allow condensate to pass through while trapping larger contaminants. In these embodiments, the dimensions and/or geometry of the perforations and/or pores may be configured based on the contaminants to be captured by the contaminant traps 122. In some embodiments, the plurality of contaminant traps may include mesh screens, such as fine mesh screens made of steel, nylon, or any other similar material. In these embodiments, the mesh screen may be capable of capturing debris and other particles that have a size larger than the size of the openings of the mesh screen, while allowing condensate to pass through the mesh screen.

Further still, in some embodiments, the contaminant traps 122, such as the zigzag contaminant traps 122*a* and 122*b* and parallel contaminant traps 122*c*, may include specialized filter media, such as carbon or other synthetic fibers. The contaminant traps 122 may utilize fibers that have particular adsorptive properties that may allow the contaminant traps 122 to attract and/or capture contaminants including odors, organic compounds, and/or chemicals present in the condensate. In some embodiments, the contaminant traps 122, such as the zigzag contaminant traps 122*a* and 122*b* and parallel contaminant traps 122*c*, may include baffle chambers, or other similar mechanisms capable of altering the flow direction of the condensate as the condensate traverses the condensate tray assembly 110. For example, altering the flow of the condensate across the condensate tray assembly 110 may cause larger and/or heavier contaminants to settle against the plurality of walls 120 of the condensate tray assembly 110 as the condensate flows. In some embodiments, the contaminant traps 122, such as the zigzag contaminant traps 122*a* and 122*b* and parallel contaminant traps 122*c*, may include magnetic traps. For example, the contaminant traps 122 may include magnetic traps that may be configured for removing metallic contaminants and/or particles from the condensate. In these embodiments, the contaminant traps 122 may magnetically attract and retain ferrous contaminants as the condensate passes through the plurality of contaminant traps 122.

It should be appreciated that the foregoing is presented for illustrative purposes only, and the contaminant traps 122, such as the zigzag contaminant traps 122*a* and 122*b* and parallel contaminant traps 122*c*, may include any type of trap capable of separating contaminants from the condensate that flows across the condensate tray assembly 110 without departing from the scope of the present disclosure. It should be understood that the plurality of contaminant traps 122, such as the zigzag contaminant traps 122*a* and 122*b* and parallel contaminant traps 122*c*, may include a variety of different contaminant traps 122. For example, as illustrated in FIGS. 3A-4B, in some embodiments, the contaminant traps 122, such as the zigzag contaminant traps 122*a* and 122*b* and parallel contaminant traps 122*c*, may include different sets of contaminant traps 122, such as a first plurality of contaminant traps 122*a* and a second plurality of contaminant traps 122*b* with different filtering structures, such as fine mesh screens, filter media, and magnetic traps. Accordingly, it should be understood that each set of contaminant traps 122, such as the zigzag contaminant traps 122*a* and 122*b* and parallel contaminant traps 122*c*, may include any number and type of contaminant traps 122 without departing from the scope of the present disclosure. Furthermore, in some embodiments, it may be advantageous to filter larger particles from the condensate first (e.g., along the plurality of walls, such as the zigzag walls 120*a* and 120*b*, positioned towards the proximal end 112 of the condensate tray assembly 310 or 410 in FIGS. 3A and 3B or along the base plate 116 from the proximal end 112 to the distal end 114 in FIGS. 4A and 4B). However, it should be appreciated that the plurality of contaminant traps 122 may be arranged in order to most efficiently trap contaminants of a particular type within a heat pump system 10.

Figure 2A:
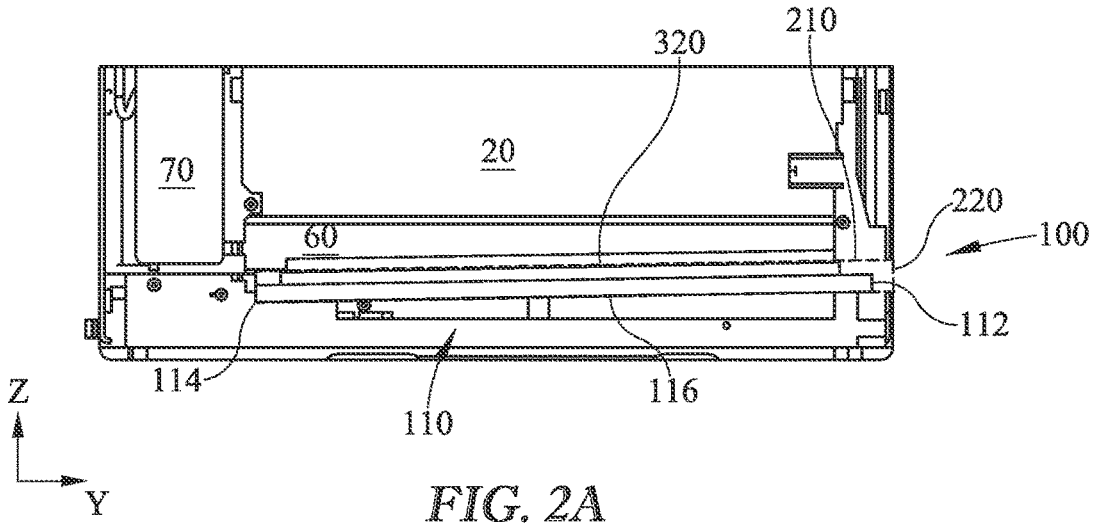
FIG. 2A schematically depicts a front view of a heat exchanger of the heat pump system with an engaged condensate tray assembly according to one or more embodiments shown and described herein.
Figure 2B:
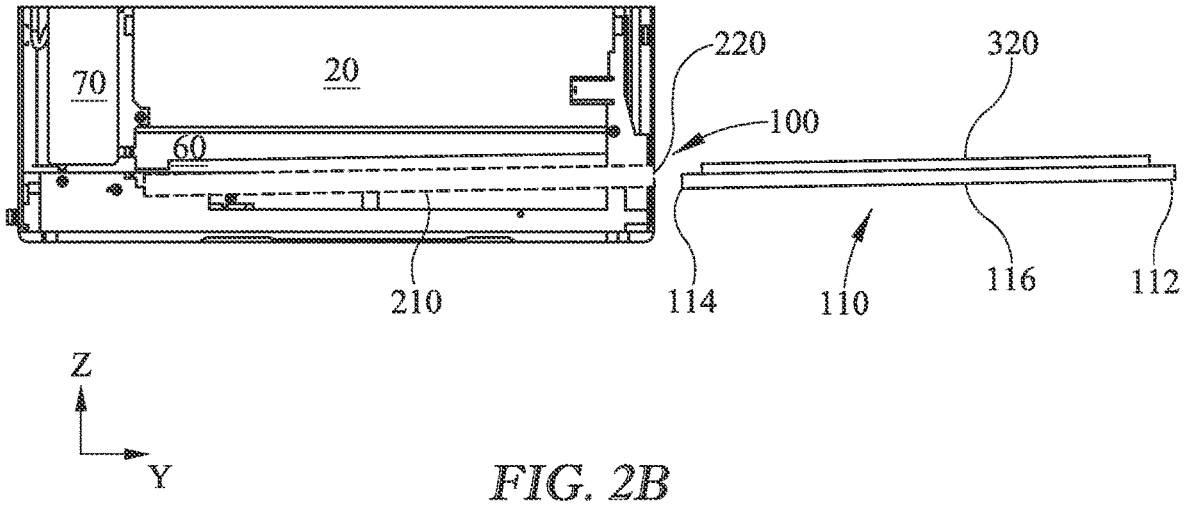
FIG. 2B schematically depicts a front view of a heat exchanger of the heat pump system with a disengaged condensate tray assembly according to one or more embodiments shown and described herein.

Referring again to FIGS. 2A and 2B, in some embodiments, the heat pump system 10 may include a condensate tray slot 210, which includes an opening 220 to an external surface of the heat pump system 10. As illustrated in FIG. 2A, the opening 220 may be configured to allow the condensate tray assembly 110 to be slideably inserted into the heat pump system 10. The condensate tray assembly 110 may be positioned under, e.g., the heat exchanger 20 or the condensation pan 60 to collect or facilitate movement of the condensate. As illustrated in FIG. 2B, the condensate tray assembly 110 may be slideably removed from the condensate tray slot 210. Accordingly, the condensate tray assembly 110 may be configured to be operably engaged with the condensate tray slot 210 to filter the condensate and operably disengaged from the condensate tray slot 210 to remove collected or retained contaminants and/or replace contaminant traps. It should be appreciated that, when the condensate tray assembly 110 is engaged with the condensate tray slot 210, the proximal end 112 of the base plate may be elevated (e.g., in the y-direction as depicted in the coordinate axis of FIGS. 2A-4B) relative to the distal end 114 of the base plate 116 to facilitate conveyance of condensate.

In some embodiments, the proximal end 112 of the base plate 116 may be fluidly coupled to drainage mechanisms of the first and/or second condensation pan 60, 62 such that, as condensate enters the condensate tray assembly 110, the slope of the base plate 116 of the condensate tray assembly 110 may allow for gravity to transport the condensate from the proximal end 112 of the base plate 116 to the distal end 114 of the base plate 116. In some embodiments, the heat pump system 10 may not include the first condensation pans 60 and/or the second condensation pan 62 but with the condensate tray assembly 110 of the filtration system 100 directly disposed under the first heat exchanger 20 to collect the condensate generated by the first heat exchanger 20 and/or the second heat exchanger 30. In such embodiments, the condensate tray assembly 110 may further include condensate guide mechanisms (such as the incline panels 501 and 511 in FIGS. 5A and 5B) positioned above condensate tray assembly 110 such that the condensate is directed to flow into the condensate tray assembly 110.

In some embodiments, the distal end 114 of the base plate 116 may be fluidly coupled to the distribution system 70, such that treated condensate (e.g., condensate that has been cleansed of contaminants after flowing across the condensate tray assembly) may be supplied from the filtration system 100 to the distribution system 70.

Although the condensate tray assembly 110 is depicted in FIGS. 2A-4B to include the proximal end 112 elevated relative to the distal end 114, it should be appreciated that the condensate tray assembly 110 may include the opposite orientation (e.g., a distal end 114 elevated relative to a proximal end 112) without departing from the scope of the present disclosure. However, it should be appreciated that, in the embodiments described herein, the elevated end (e.g., distal or proximal end) of the condensate tray assembly 110 may be fluidly coupled to the condensation pan 60 (if present) such that the condensate transferred from the condensation pan 60 to the condensate tray assembly 110 may traverse the condensate tray assembly 110 via the force of gravity.

With continued reference to FIGS. 2A-4B, in the embodiments described herein, the condensate tray assembly 110 may be further configured to maintain a minimum condensate level even at times when condensate is not actively flowing from the condensation pan 60 into the condensate tray assembly 110. For example, in these embodiments, the condensate tray assembly 110 may trap a volume of the condensate passing across the condensate tray assembly 110 to ensure that the minimum condensate level is maintained.

Referring to FIGS. 5A and 5B, front views of the condensate tray assembly including incline panels are depicted. In some embodiments, as illustrated in FIG. 5A, the condensate tray assembly 500 may include the base plate 116 with contaminant traps 122 on the top and guide walls 503 of the base plate 116 on the side edges 125 and 127. The condensate tray assembly 110, 310, or 410 may further include two incline panels 501. Each incline panel 501 may be operably engaged with one of the guide walls 503. The incline panels 501 may be fixedly attached in the heat pump system 10 in a position below a heat exchanger (e.g., the heat exchanger 20) such that the condensate generated by the heat exchanger may be guided to drop into or flow to the contaimant traps 122. When the condensate tray assembly 500 is disengaged from the heat pump system 10, the parts of the base plate 116, contaminant traps 122, and the guide walls 503 may be removed from the heat pump system 10.

Referring to FIG. 5B, in some embodiments, the condensate tray assembly 110, 310, or 410 may include the base plate 116 of the base plate with contaminant traps 122 on the top and guide walls 511 on the side edges 125 and 127. The guide wall 511 may further extend upward to include incline panels. The guide wall 511 including the incline panels may be fixedly attached in the heat pump system 10 such that when the condensate tray assembly 510 is removed from the heat pump system 10, the guide wall 511 remain in the heat pump system 10. In some embodiments, the base plate 116 may be fixedly attached to the guide wall 511 to be fixedly attached in the heat pump system 10 such that when the condensate tray assembly 510 is disengaged from the heat pump system 10, the contaminant traps 122 may be removed from the heat pump system 10 while the guide wall 511 and the base plate 116 may be retained in the heat pump system 10.

Referring again to FIGS. 1-4B, once the condensate has passed through the filtration system 100 (e.g., over the condensate tray assembly 110), the filtered condensate may be passed to the distribution system 70. As should be appreciated in view of the foregoing, the filtered condensate may alleviate the issues with clogging of the distribution system 70, humidification system 80, and/or misting nozzle 90 which are generally caused by the contaminants. In these embodiments, the condensate stored by the condensate tray assembly 110 at the minimum condensate level may be sufficient to not produce odors (e.g., musty or other similar type odors) from the contaminants trapped in the condensate tray assembly 110, which may minimize cleaning and/or maintenance of the condensate tray assembly 110.

Figure 6:
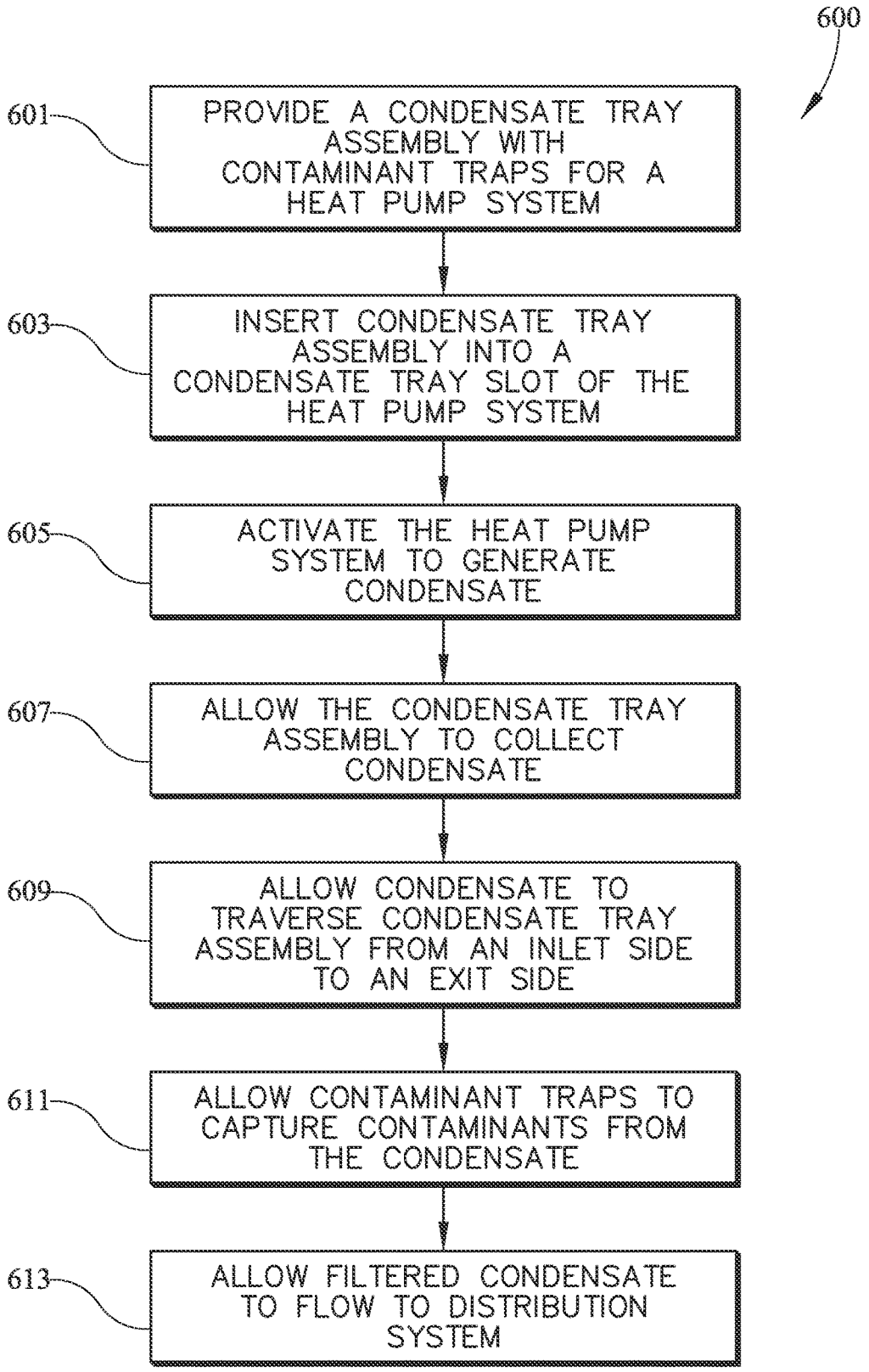
FIG. 6 depicts an illustrative flow diagram of a method of filtering a condensate.

Turning now to FIG. 6, an illustrative flow diagram of a method 600 of filtering a condensate is depicted. At block 601, the present method 600 may include providing condensate tray assembly 110, 310, or 410 (e.g., as illustrated in FIG. 2B) with contaminant traps 122 (e.g., as illustrated in FIGS. 3A-4B) for a heat pump system 10.

At block 603, the present method 600 may include inserting condensate tray assembly 110, 310, or 410 into a condensate tray slot 210 (e.g., as illustrated in FIG. 2B) of the heat pump system 10 (e.g., as illustrated in FIG. 1). The condensate tray assembly 110 may be positioned downstream of a heat exchanger 20 (e.g., as illustrated in FIG. 1) of the heat pump system 10. As illustrated in FIG. 2B, the condensate tray assembly 110 may be inserted into the condensate tray slot 210 to be positioned under the first heat exchanger 20.

At block 605, the present method 600 may include activating heat pump system 10 to generate condensate. The condensate may be formed by the heat exchangers 20, 30 (e.g., as illustrated in FIG. 1).

At block 607, the present method 600 may include allowing the condensate tray assembly 110, 310, or 410 to collect condensate. As illustrated in FIG. 1, the heat pump system 10 may collect condensate formed by the first heat exchanger 20 in a condensation pan 60 and further transfer the condensate from the condensation pan 60 to the condensate tray assembly 110. In some embodiments, the heat pump system 10 may not include the condensation pan 60 and the condensate tray assembly 110 may collect the condensate formed by the first heat exchanger 20. In some embodiments, as illustrated in FIG. 1, the first and/or second condensation pan 60, 62 may be fluidly coupled to the condensate tray assembly 110, such that condensate collected by either the first and/or second condensation pan 60, 62 may be transferred to the condensate tray assembly 110.

At block 609, the present method 600 may include allowing condensate to traverse condensate tray assembly 110, 310, or 410 from inlet side (e.g., the proximal end 112 in FIGS. 2B-4B) to exit side (e.g., the distal end 114 in FIGS. 2B-4B). The condensate may passively traverse through a plurality of contaminant traps 122 (e.g., as illustrated in FIGS. 3A-4B) arranged on the condensate tray assembly 110 (e.g., as illustrated in FIG. 2B). As illustrated in FIGS. 3A-4B, the condensate tray assembly 310 or 410 may include a base plate 116 having a distal end 114, a proximal end 112, and a base plate 116 extending from the proximal end 112 to the distal end 114. The proximal end 112 may be elevated relative to the distal end 114, such that the base plate 116 is sloped. Accordingly, the passively traversing the condensate through a plurality of contaminant traps 122, such as the zigzag contaminant traps 122*a* and 122*b* as in FIGS. 3A and 3B and parallel contaminant traps 122*c* as in FIGS. 4A and 4B, arranged on the condensate tray assembly 110 of the present method 600 may further involve passively traversing the condensate to the distal end 114 of the base plate 116, such that the slope of the base plate 116 causes the condensate to traverse the base plate 116 via gravity.

At block 611, the present method 600 may include allowing contaminant traps 122 to capture contaminants from the condensate. Contaminants within the condensate may become trapped within the contaminant traps 122, such as the zigzag contaminant traps 122*a* and 122*b* as in FIGS. A and 3B and parallel contaminant traps 122*c* as in FIGS. 4A and 4B, as the condensate traverses the condensate tray assembly.

At block 613, the present method 600 may include allowing filtered condensate to flow to distribution system 70 (e.g., as illustrated in FIGS. 1-2B). As illustrated in FIGS. 1 and 2A, once the condensate has traversed through the condensate tray assembly 110 and the contaminants have been removed, the distribution system 70 may utilize the condensate to humidify an inside room in which the heat pump system 10 is positioned, or may exhaust the condensate via a misting nozzle 90 safely to an external (e.g., outside) environment.

In some embodiments, the plurality of contaminant traps 122, such as the zigzag contaminant traps 122*a* and 122*b* as in FIGS. 3A and 3B and parallel contaminant traps 122*c* as in FIGS. 4A and 4B, may be formed on a sloped base plate 116 of the condensate tray assembly 110 (e.g., as illustrated in FIG. 2B). The present method 600 may further involve passing the condensate across the sloped condensate tray assembly 110 via gravity. The slidably engaging a condensate tray assembly 110 with a condensate tray slot 210 (e.g., as illustrated in FIG. 2B) of the heat pump system 10 (e.g., as illustrated in FIG. 1) may further include engaging the condensate tray assembly 110 with incline panels 501 or 511 (e.g., as illustrated in FIGS. 5A and 5B).

In some embodiments, the present method 600 may further include determining whether a level of contamination of the contaminant traps 122, such as the zigzag contaminant traps 122*a* and 122*b* as in FIGS. 3A and 3B and parallel contaminant traps 122*c* as in FIGS. 4A and 4B, reaches a level requiring further action. In response to determining that the contaminant degree of the contaminant traps 122 reaches the maximum contaminant degree, disengaging the condensate tray assembly 110 (e.g., as illustrated in FIG. 2B) from the condensate tray slot 210 (e.g., as illustrated in FIG. 2B). The present method 600 may further include removing secured contaminants from the contaminant traps 122 or replacing the contaminant traps 122.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined. The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

It is to be understood that the embodiments are not limited in their application to the details of construction and the arrangement of components set forth in the description or illustrated in the drawings. The invention is capable of some embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. A condensate tray assembly for filtering condensate from a heat pump comprising:

a base plate having a substantially planar geometry, the base plate comprising a proximal end, a distal end, a left side edge, and a right side edge, the proximal end configured to be elevated relative to the distal end such that the condensate from the heat pump flows from the proximal end of the base plate toward the distal end of the base plate;

side walls coupled to the base plate near the side edges; and a plurality of contaminant traps coupled to the base plate, each said contaminant trap comprising an inflow leg and an outflow leg, wherein the contaminant traps are aligned against the condensate flow to facilitate collection of contaminants present in the condensate as the flow of condensate traverses across the condensate tray, wherein the condensate tray assembly is configured to be slidably engageable with a condensate tray slot of the heat pump, and the condensate tray slot comprises an opening to an external surface of the heat pump.

2. The condensate tray assembly of claim 1, wherein the condensate tray assembly is configured to be operably engageable with the condensate tray slot to filter the condensate and operably disengageable from the condensate tray slot to remove collected contaminants.

3. The condensate tray assembly of claim 1, wherein the side walls are taller than the contaminant traps.

4. The condensate tray assembly of claim 3, wherein the condensate flows toward the distal end without overflowing the side walls when the contaminant traps reach a predetermined level of contamination.

5. The condensate tray assembly of claim 1, wherein a settling groove is formed between a pair of neighboring contaminant traps between the outflow leg of a first neighboring contaminant trap and the inflow leg of a second neighboring contaminant trap.

6. The condensate tray assembly of claim 1, wherein the contaminant traps further comprise one or more pleated screens.

7. The condensate tray assembly of claim 6, wherein the pleated screens further comprise mesh screens or filter media.

8. The condensate tray assembly of claim 1, wherein one or more of the contaminant traps are perpendicular to the side walls.

9. The condensate tray assembly of claim 1, wherein the heat pump comprises a condensate pan fluidly coupled to the condensate tray assembly, the condensate pan configured to receive the condensate formed by the heat pump and transfer the condensate to the proximal end of the base plate.

10. A condensate tray assembly for filtering condensate from a heat pump comprising:

a base plate having a substantially planar geometry, the base plate comprising a proximal end, a distal end, a left side edge, and a right side edge, the proximal end configured to be elevated relative to the distal end such that the condensate from the heat pump flows from the proximal end of the base plate toward the distal end of the base plate;

a plurality of contaminant traps coupled to the base plate, each said contaminant trap comprising an inflow leg and an outflow leg, wherein the contaminant traps are aligned against the condensate flow to facilitate collection of contaminants present in the condensate as the flow of condensate traverses across the condensate tray; and wherein the condensate tray assembly is configured to be slidably engageable with a condensate tray slot of the heat pump, and the condensate tray slot comprises an opening to an external surface of the heat pump.

11. The condensate tray assembly of claim 10, wherein the condensate tray assembly is configured to be operably engageable with the condensate tray slot to filter the condensate and operably disengageable from the condensate tray slot to remove collected contaminants.

12. The condensate tray assembly of claim 10, wherein a settling groove is formed between a pair of neighboring contaminant traps between the outflow leg of a first neighboring contaminant trap and the inflow leg of a second neighboring contaminant trap.

13. The condensate tray assembly of claim 10, wherein the heat pump comprises a condensate pan fluidly coupled to the condensate tray assembly, the condensate pan configured to receive the condensate formed by the heat pump and transfer the condensate to the proximal end of the base plate.

14. A condensate tray assembly for filtering condensate from a heat pump comprising:

a base plate having a substantially planar geometry, the base plate comprising a proximal end, a distal end, a left side edge, and a right side edge, the proximal end configured to be elevated relative to the distal end such that the condensate from the heat pump flows from the proximal end of the base plate toward the distal end of the base plate;

side walls coupled to the base plate near the side edges; and a plurality of contaminant traps coupled to the base plate and perpendicular to the side walls, each said contaminant trap comprising an inflow leg and an outflow leg, wherein the contaminant traps are aligned against the condensate flow to facilitate collection of contaminants present in the condensate as the flow of condensate traverses across the condensate tray, wherein the condensate tray assembly is configured to be slidably engageable with a condensate tray slot of the heat pump, and the condensate tray slot comprises an opening to an external surface of the heat pump.

15. The condensate tray assembly of claim 14, wherein:

the condensate tray assembly is configured to be operably engageable with the condensate tray slot to filter the condensate and operably disengageable from the condensate tray slot to remove collected contaminants.

16. The condensate tray assembly of claim 14, wherein the side walls are taller than the contaminant traps.

17. The condensate tray assembly of claim 16, wherein the condensate flows toward the distal end without overflowing the side walls when the contaminant traps reach a predetermined level of contamination.

18. The condensate tray assembly of claim 17, wherein a settling groove is formed between a pair of neighboring contaminant traps between the outflow leg of a first neighboring contaminant trap and the inflow leg of a second neighboring contaminant trap.

* * * * *